United States Patent [19]

Papsdorf

[11] Patent Number: 4,787,190

[45] Date of Patent: Nov. 29, 1988

[54] ROOF TILES AND FASTENING DEVICES

[75] Inventor: Kurt R. Papsdorf, Furstenfeldbruck, Fed. Rep. of Germany

[73] Assignee: Evertile Building Systems Canada Ltd., Delta, Canada

[21] Appl. No.: 48,008

[22] Filed: May 8, 1987

Related U.S. Application Data

[63] Continuation-in-part of Ser. No. 884,396, Jul. 11, 1986, abandoned.

[51] Int. Cl.[4] ..... E04D 1/20

[52] U.S. Cl. ..... 52/553; 52/543

[58] Field of Search ..... 52/520, 521, 543, 553, 52/537, 539, 536, 542

[56] References Cited

U.S. PATENT DOCUMENTS 973,946 10/1910 Lindau ..... 52/553 X 1,416,583 5/1922 Seiler ..... 52/553 X 2,151,794 3/1939 Peebles ..... 52/553 X 2,482,835 9/1949 Bremer ..... 52/553 X 3,579,940 5/1971 Greenleaf ..... 52/553 X

FOREIGN PATENT DOCUMENTS 518445 1/1931 Fed. Rep. of Germany ..... 52/553

*Primary Examiner*—David A. Scherbel

*Assistant Examiner*—Richard E. Chilcot, Jr.

*Attorney, Agent, or Firm*—Barrigar & Oyen

[57] ABSTRACT

The invention provides a roof tile which is designed in such a way as to interlock and slidingly engage with all surrounding neighbor roof tiles such that lifting of the top tiles from the bottom tiles is prevented. The invention further provides a roofing system comprising these roof tiles. Moreover, the invention provides fastening elements and profiles for securing the roof tiles to purlins.

11 Claims, 6 Drawing Sheets

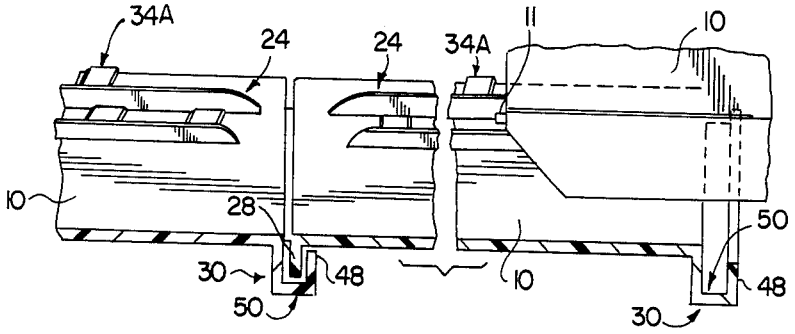
FIG. 11
FIG. 12
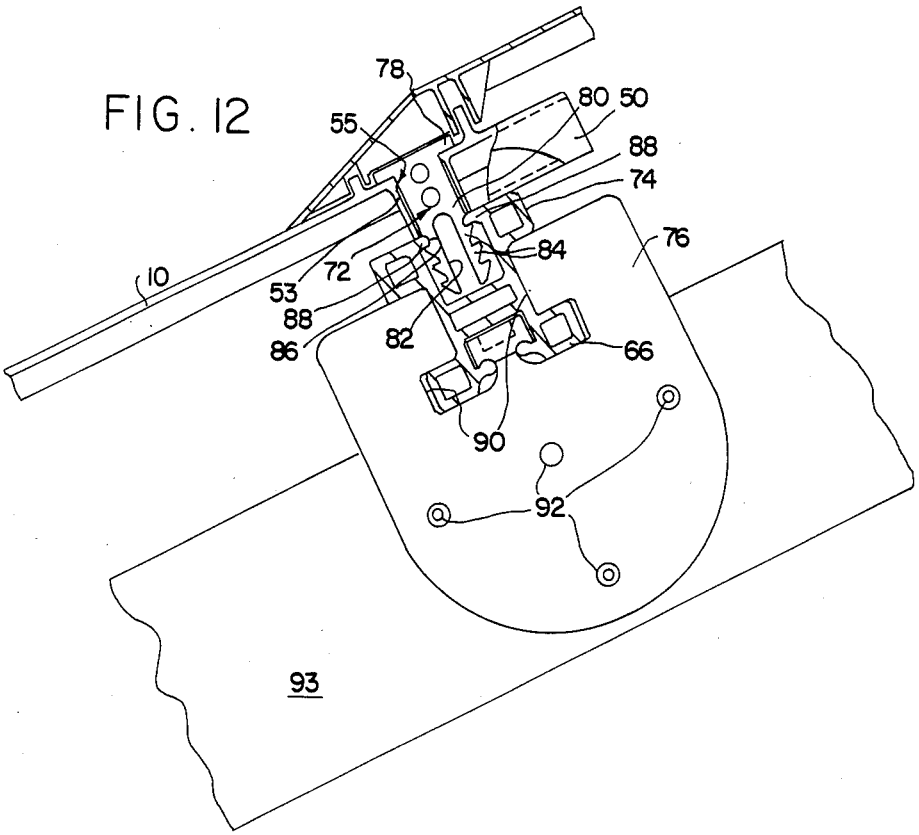

ROOF TILES AND FASTENING DEVICES

CROSS REFERENCE TO RELATED APPLICATION

This invention relates to roof tiles and fastening methods and devices.

INTRODUCTION

In accordance with the invention, there is provided a roof tile, preferably in the form of a moulding of synthetic plastic material, and fastening devices of the same or similar material.

The material may include a flame retardant polycarbonate or polypropylene or polyester resin with fillers of mineral or waste products, or such synthetic materials suitable for roof tiles and their fittings.

The tile may be of any suitable shape reflecting the appearance of traditional roof tiles.

The tile has interlocking formations adapted to co-operate with interlocking formations of other similar tiles to effect interlocking.

Preferably these interlocking formations are formed such that the tile is thereby interlocked with other similar tiles to form a greatly self-supporting roof structure. It is however important to note, that nearly all roof tiles have similar functions. This roof tile does not interlock in the usual or traditional manner but interlocks and slidingly engages also with the tile underneath as well as with its surrounding neighbors, therefore tiles connected this way are creating a self-supporting structure. Important with synthetic materials is also the behavior of chemical compositions. In nature, and exposed to all kind of weather conditions they might deteriorate prematurely if not properly applied. Because of the light weight of the tiles which can be as low as 2.8 kg per $m^2$ covered roof area, they require a good fastening down onto suitable strappings. However, synthetic thermoplastics which are ideally suited for roofing material should not be fastened by nailing or screwing. Firstly, it restricts the thermal expansion or contraction of the tiles, but permanent tension on the material creates stress and subsequent cracks in the material.

It is also to note that an absolutely free movement of each tile longitudinally as well as laterally must be maintained with a minimum of friction, yet still creating an all-weather proof skin. Neither of the studied roofing techniques incorporate such features.

Seeing that suitable synthetic plastic materials for roofs have existed only for about 20 years, and are getting improved all the time, no practical long-term experience relating to weathering and use as roofing material existed. In view of information now available regarding such synthetic materials having commercially viable application systems, the inventor believes to have found a new and innovative way combining all necessary factors.

SUMMARY OF THE INVENTION

The interlocking formations may include longitudinal interlocking formations to effect interlocking in a longitudinal, direction. The interlocking formations may thus include complementary first and second interlocking formations respectively at a top and toward a rear, and at a bottom and toward a front, of the tile. In use, the first interlocking formation of a first tile will co-operate with the second interlocking formation of another tile rearward of and overlapping the first tile. The second interlocking formation of the first tile will co-operate with the first interlocking formation of another tile forward of and overlapped by the first tile.

To allow tiles in adjacent rows to be arranged in bonded formation, the first and second interlocking formations may extend laterally and parallel to front and rear edges of the tile which front and rear edges will also be parallel. The interlocking formations may respectively be in the form of female grooves or slots and male projections.

In a preferred embodiment, all the interlocking formations are adapted to inter-engage non-frictionally to allow thermal expansion and contraction and provide ease of handling and laying.

The interlocking formations may also include lateral interlocking formations to effect lateral interlocking. The interlocking formations may thus include complementary third and fourth interlocking formations respectively at side edges of the tile. Thus, the third interlocking formation of one tile will co-operate with the fourth interlocking formation of an adjacent tile. All the interlocking formations may be adapted to inter-engage with clearance. One of the third and fourth interlocking formations may be in the form of a furrow suitable to conduct water.

The top of the tile may be suitably structured to give a desired appearance. The bottom of the tile may be dished. Support formations may be provided on the bottom flush with a rim of the tile to support the tile on support structure. Reinforcing ribs may be provided on the bottom and/or top of the tile.

The invention extends to a method of laying roof tiles including interlocking a tile respectively with tiles surrounding it by means of complementing interlocking formations on the tiles and their sliding engagement into other surrounding tiles.

Preferably, this method is characterized by interlocking the tiles with one another such that a self-supporting tile structure is formed.

A preferred embodiment of this method comprises securing at least some of the tiles to purlins by connecting the tiles by fastening elements to strappings or specially designed profiles secured to the purlins and crossing said purlins.

It is preferred that the profiles be secured by connecting elements especially designed to engage the purlins and that the fastening elements be secured displaceably in the lateral direction of the profiles to the purlins.

Interlocking of these formations must be non-frictional to allow ease of application and thermal expansion or contraction or to allow movement in the roof structure due to adverse weather conditions.

The invention is now described by way of example with reference to the accompanying diagrammatic drawing. In the drawings FIG. 1 shows, in top plan view, the shape of a preferred embodiment of a roof tile in accordance with the invention;

FIG. 7 shows, to a larger scale and partly in sectional view, views corresponding to VII—VII of FIG. 6, with FIG. 7 showing the fastening of a roof tile by means of fastening elements, profile and connecting elements, whereas

FIG. 11 shows, to a larger scale, a view corresponding to VIII—VIII of FIG. 6;

FIG. 12 shows the fastening of the tiles by means of fastening elements, profile and connecting elements to the purlins in a view corresponding to FIG. 7.

DESCRIPTION OF THE PREFERRED EMBODIMENTS

Figure 1:
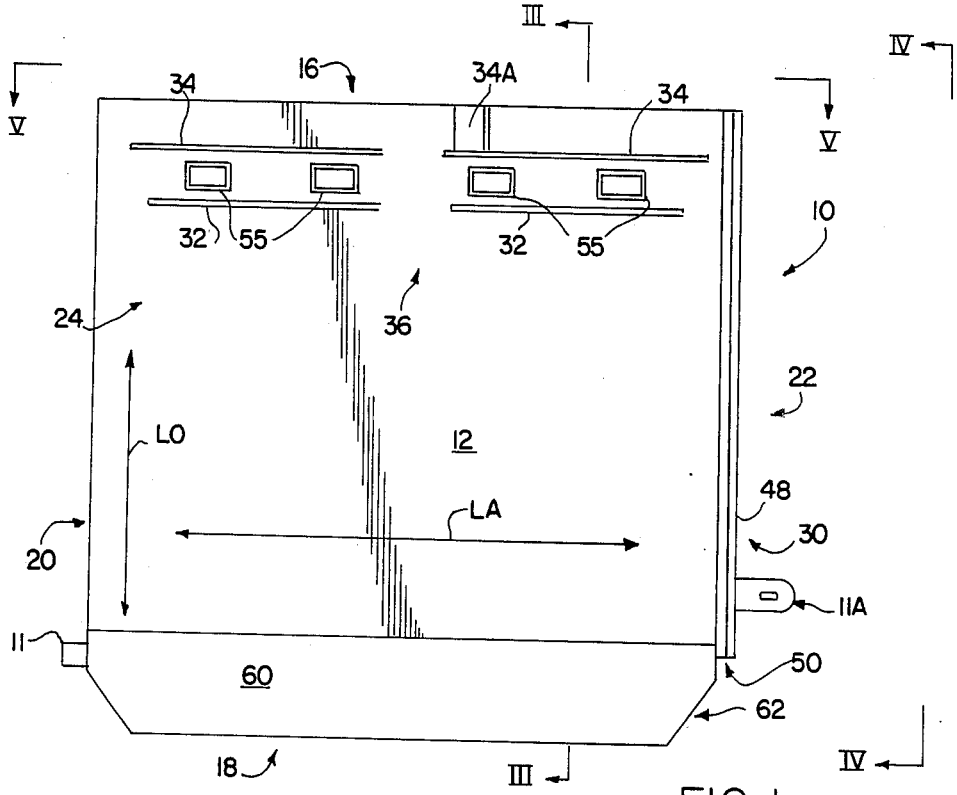

A preferred embodiment of a roof tile in accordance with the invention is now described with reference to FIGS. 1 to 5 of the drawings. The roof tile is generally indicated by reference numeral 10.

The roof tile 10 has a top 12 which is generally flat or of a structural design and a bottom which is dished. It has a rear 16, a front 18 and first and second sides 20, 22. It is substantially square having sides of about 300 mm.

The tile 10 has longitudinal interlocking formations to effect interlocking with similar tiles in a longitudinal direction. The tile 10 also has lateral interlocking formations to effect interlocking with similar tiles in a lateral direction. The lateral interlocking formations extend generally longitudinally. For purposes of this specification "longitudinal" and "lateral" must be interpreted from the eyes of an observer standing transversely in front of a roof and looking towards the roof on which roof tiles are laid. "Longitudinal" will be in the direction in which he is looking. The front 18 of the tile will be near to him, and the rear 16 will be remote from him. "Lateral" will be towards his left or right. The longitudinal direction is indicated by arrow LO in FIG. 1, and the lateral direction is indicated by arrow LA.

The longitudinal interlocking formations include a first interlocking formation 24 standing upright of the top 12 and disposed towards the rear 16, and a complementary second interlocking formation 26 in the bottom 14 and towards the front 18. The first and second interlocking formations 24 and 26 are complimentary in the sense that they can co-operate with respective first and second interlocking formations of other, identical tiles. When tiles are laid on a roof the first interlocking formation of one tile will co-operate with the second interlocking formation of another tile to the rear and overlapping the first tile. The second interlocking formation of one tile will co-operate with the first interlocking formation of yet another tile to the front of and underlying said one tile. The differences in height of formation 34 and 32 are important. The higher formation 34 creates a back pressure should wind enter on front 18.

The first interlocking formation 24 comprises a pair of longitudinally spaced male flanges 32, 34. The flanges 32 and 34 are parallel to each other and to the rear 16 of the tile. At the centre of the tile, the flanges 32 and 34 are interrupted to provide a passage 36 to accommodate a fourth interlocking formation of an overlapping tile.

The second interlocking formation 26 is defined by a pair of closely spaced laterally extending ribs 38, 40 defining a groove 44 therebetween, and by laterally aligned slots 46 in short longitudinal ribs 42 extending toward the front 18 from the rib 40. The width of the groove 44 in relation to the thickness of the flange 34 is such that they engage non-frictionally to allow expansion and contraction. The outer extremities of the ribs 38, 40 and 42 are co-planar.

The lateral interlocking formations include, along the first side 20, a downwardly turned flange 28 forming a third interlocking formation. The flange 28 extends from rear 16 toward and nearly up to the front 18. The lateral interlocking formations include also a fourth interlocking formation in the form of a channel formation 30 along the second side 22. The channel formation 30 includes a flange 48 defining the second side 22 and forming a channel 50 inward thereof and adapted to receive a flange 28 of an adjacent tile with clearance. The clearance fit allows the channel 50 to act as a channel for water and to allow thermal expansion or contraction and to allow structural adjustments. The bottom of the channel formation 30 is co-planar with the outer extremities of the ribs 38, 40, 42.

Apertures 55 which are preferably of square or rectangular shape and which are used for securing the tiles 10 by means of fastening elements or snappers inserted through the apertures 55 are provided in the tiles 10 as can be seen, e.g., in FIGS. 1 to 3 and 5 to 13. These apertures 55 can be positioned in a laterally aligned row. Furthermore, the apertures 55 can be provided in bosses 53. The height of each boss 53 can be such that its outer, free end is co-planar with the bottom of the channel formation 30 and the outer extremities of the ribs 38, 40, 42. Securing of the tiles by means of fastening elements or snappers inserted into the apertures 55 is described below in detail with reference to FIGS. 7 to 10, 12 and 13.

A lateral front portion adjacent to the front 18 of the tile 10 slopes downwardly to a sharp edge providing the front 18 coplanar with the channel formation 30, bosses 53 and ribs 38, 40, 42. Front corners are chamfered as indicated at 62.

The tiles 10 laid on a roof are now described in more detail with reference to FIGS. 6 to 13.

The tiles 10 are arranged in rows generally indicated at 70 (FIG. 6) such that the tiles 10 in adjacent rows are in bonded formation. Tiles in an upper row overlap tiles in a lower row and are held in position by means of flange 11 A slidingly engaged into flange holder 34 A.

Figure 7:
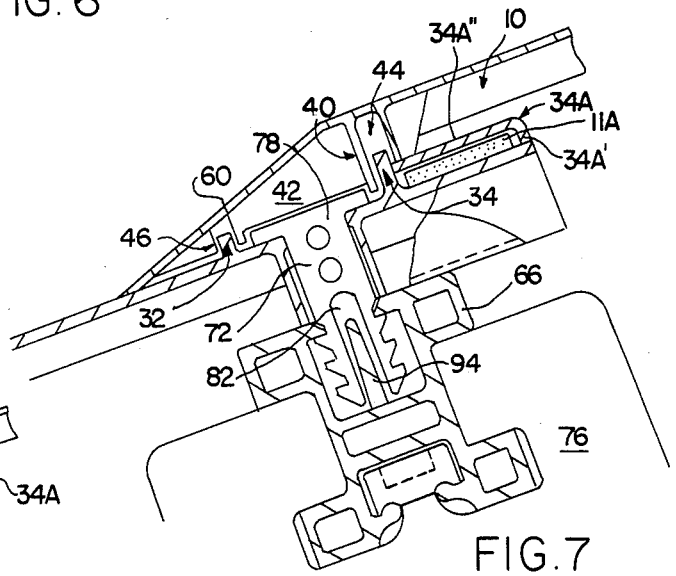
Figure 8:
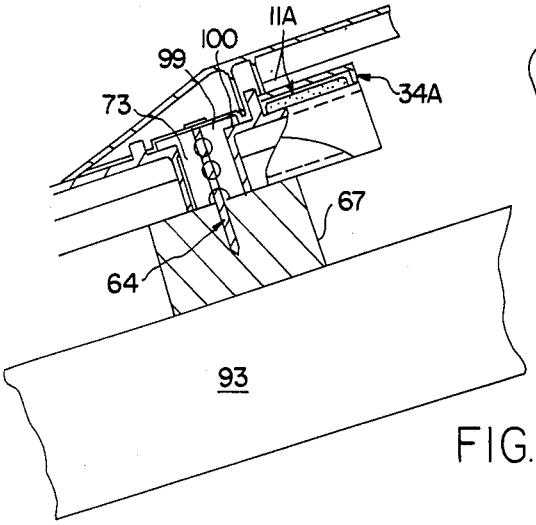
FIG. 8 shows the fastening of roof tiles by snappers and nails to strappings and purlins.
Figure 9:
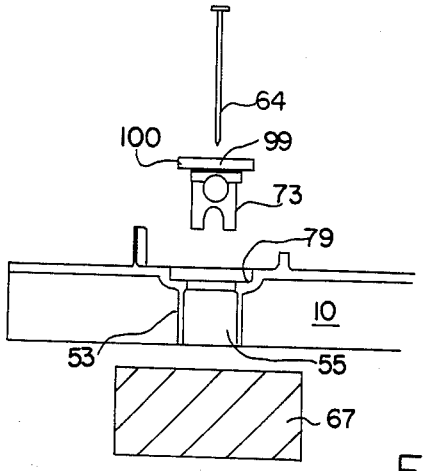
FIG. 9 shows a view corresponding to FIG. 8 however in an expanded manner with some parts omitted.

Longitudinal interlocking is illustrated in FIGS. 7, 8, 12 and 13. The flange 34 of a first tile 10 is non-frictionally engaged in groove 44 of an overlapping tile 10. Similarly, the flange 32 is received within slots 46 of the overlapping tile 10. Each tile 10 is fastened by means of snapper 73 to strapping 67 (FIG. 8) or by means of fastening element 72 to profile 66 (FIG. 7). This method of fixing is important as not to put direct stress onto the material of the tile 10. This could result in a short period of time to material stress and cracks, allowing the tile to deteriorate in its strength. It is further to be appreciated that the front 18, longitudinal ribs 42 and lateral ribs 38, 40 as well as channel formation 30 of each tile are co-planar. This allows an overlapping tile to rest flush on the top of an underlying tile. This is conducive to prevent excessive wind from entering between overlapping tiles, yet allowing ventilation under the tiles through channel 50 so that strappings 67 and roof trusses can breathe and do not prematurely age.

As can be seen from FIGS. 1 to 5, 7 and 8, the flange holder 34 A essentially comprises an L-shaped member with the shorter leg 34 A′ protruding from the upper surface of the roof tile 10 and with the longer leg 34 A″ extending essentially parallel to the upper surface of the roof tile 10 so that it defines a space for receiving flange or protrusion 11 A. The leg 34 A″ then prevents lifting of the protrusion 11 A and therefore lifting of the upper roof tile 10 having this protrusion from the lower roof tile 10 having this leg 34A″.

Figure 3:
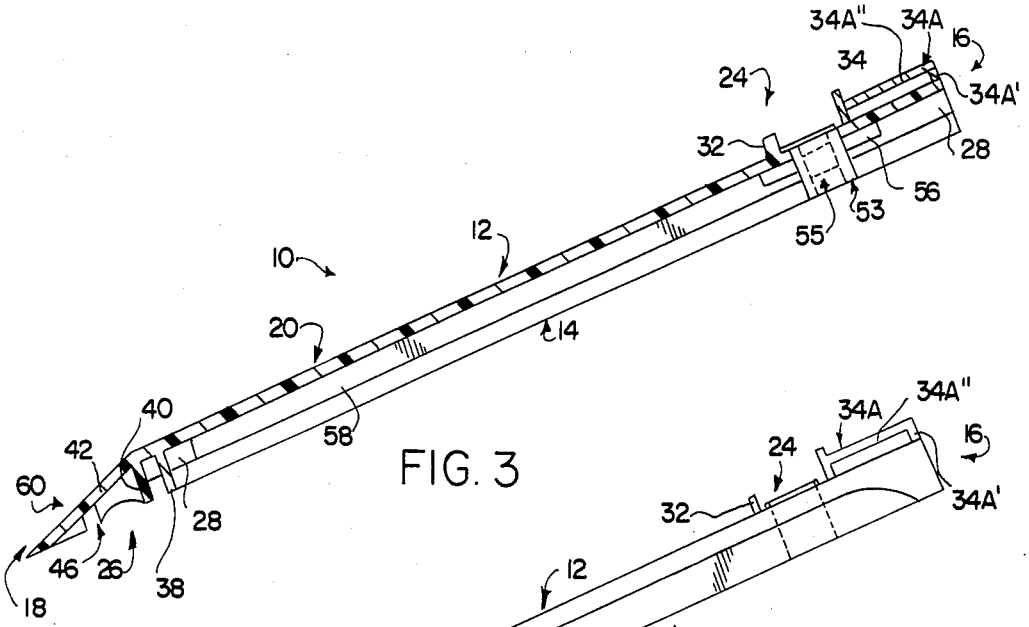
FIGS. 3, 4 and 5 show respectively views according to III—III, IV—IV and V—V in FIG. 1.
Figure 4:
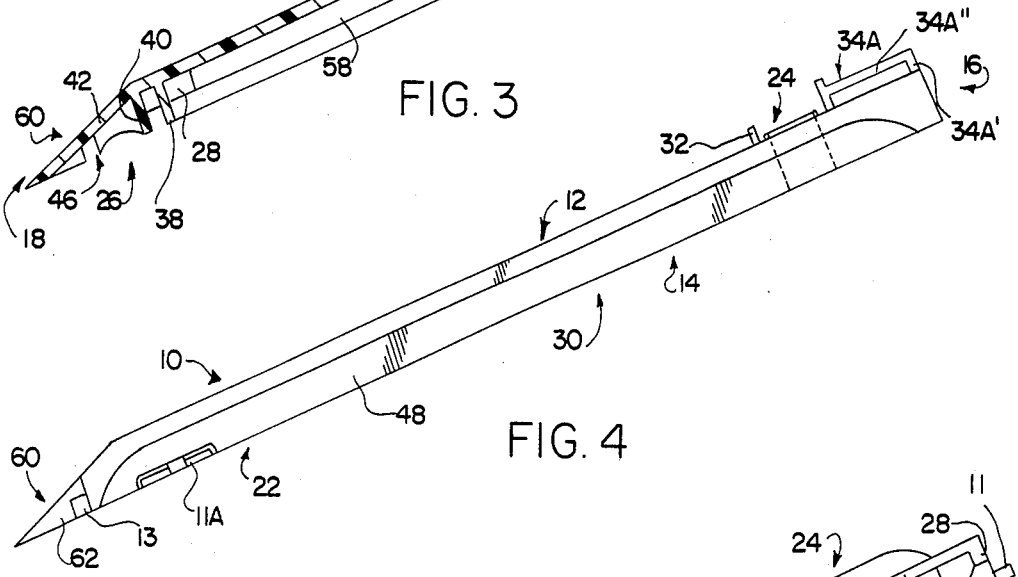

As shown in FIGS. 1, 3 and 4, the leg 34 A″ is integral with rib 34 so that rib 34 provides a guide for protrusion 11 A in the lateral direction and a stop for this protrusion 11 A in the longitudinal direction.

Figure 5:
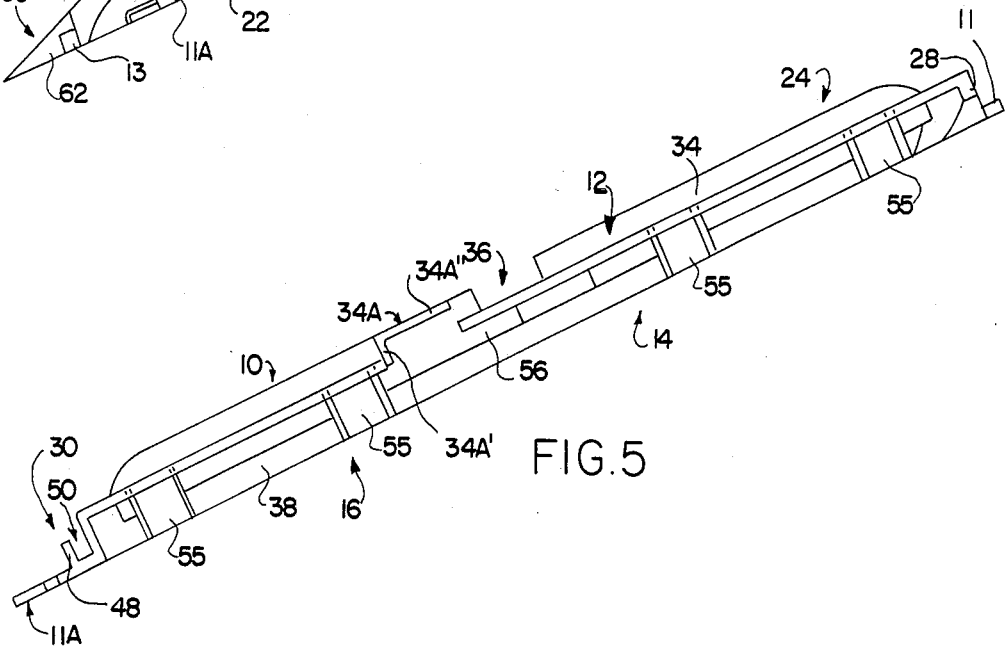
Figure 6:
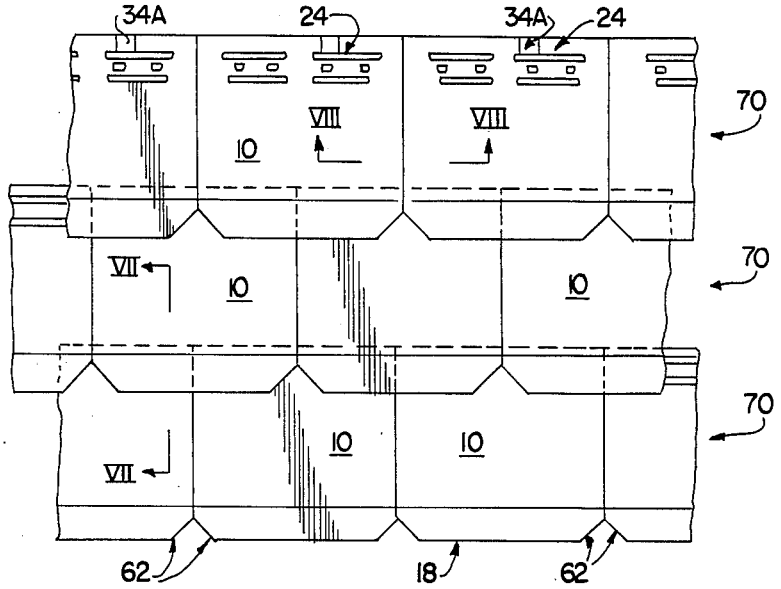
FIG. 6 shows, to a smaller scale, laying of roof tiles according to FIG. 1.
Figure 10:
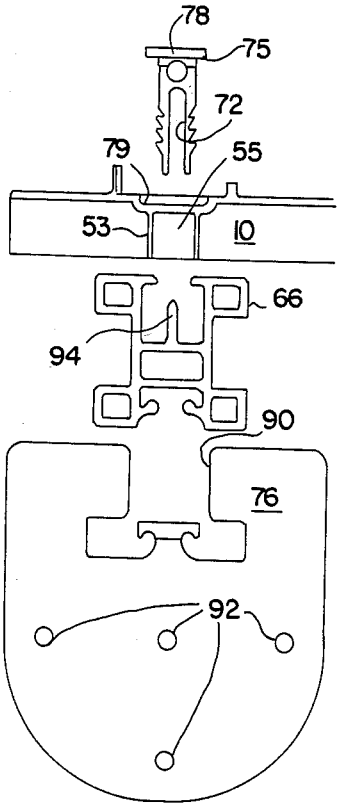
FIG. 10 shows a view corresponding to FIG. 7 however in an expanded manner with some parts omitted.

Lateral interlocking is illustrated in FIGS. 10 and 11. The flange 28 of one tile is received with clearance within channel 50 of an adjacent tile. Simultaneously flange 11 A (FIGS. 1, 4 and 5) slides into flange holder 34 A (FIGS. 5 and 11). This engages the top tile 10 to bottom tile 10 and prevents a lifting of the tiles at the front 18 (FIG. 6). Being slidingly engaged it allows also a lateral movement from left to right or vice versa to allow a sliding engagement of flange 11 (FIG. 5) into opening 13 (FIG. 4). This engagement prevents the lifting of the corner of the front left side 18 of the tile 10 (FIG. 6).

By engaging bottom tile 10 to top tile 10 in the above manner, a flexible yet strong self-supporting roof system develops. No lifting of tiles through wind or suction is possible. This is important because of the extreme light weight of the tiles.

The tile 10 shown in FIGS. 7, 10 and 12 is secured to profile 66 by means of a fastening element 72 which is inserted through the aperture 55 in boss 53 and snapped into profile 66.

The fastening element 72, at one end thereof, has a head 78 which is larger than the aperture 55 and a shank 80 which has a square or rectangular cross-section adapted to the aperture 55. The shank 80 has a slot 82 and serrations 84 at the other end so that it can be inserted elastically into an opening 86 in the upper part of the profile 66 and is retained by engagement of serrations 84 with shoulders 88 of the opening 86. The opening 86 is continuous along the length of the profile 66 so that fastening element 72 which also has a generally square or rectangular cross-section in its serrated portion can be fastened to the profile 66 at any desired position along the profile on which the tile 10 bears with the upper end of boss 53 and with channel 50, the lower extremities of which are co-planar.

The head 78 of the fastening element 72 preferably forms a lip or flange 75 around the circumference of the head 78 and the upper part of the aperture 55 can be formed as a seat 79 for the lip or flange 75.

The element 76 is inserted by means of opening 90 onto profile 66. It engages slidingly and can be adjusted to suit position of roof truss 93 (FIG. 12). The connecting element 76 has holes 92 (FIGS. 10 and 12). These are for fastening element 76 by nailing or screwing onto roof truss 93. In this way structural faults in roof trusses or their erection can be eliminated or greatly reduced because fastening plate 76 can be adjusted on roof truss 93.

The profile 66 preferably has an internal protrusion 94 (FIGS. 7 and 10) which protrudes into the slot 82 when the fastening element 72 is in position in the profile 66 (FIG. 7). Thus the protrusion 94 acts as a guiding element for the element 72 and locks the serrations 84 to the shoulders 88.

A further possibility of fastening tile 10 (FIGS. 8, 9 and 13) is by using nails 64, fastener or snapper 73 and straps 67.

Figure 13:
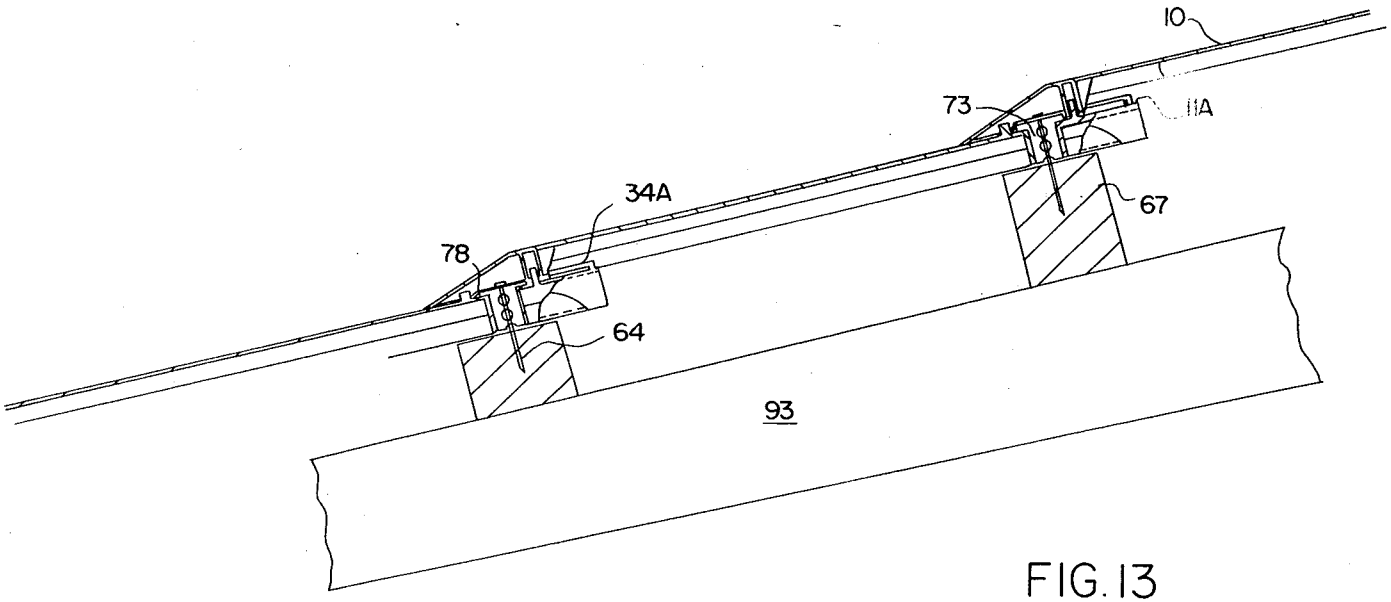
FIG. 13 shows the fastening of the tiles by means of snappers, nails and strappings to the purlins in a view corresponding to FIG. 8.

Nail 64 gets inserted through hole in fastener or snapper 73. Fastener or snapper 73 gets positioned in aperture 55. Nail 64 gets then driven into strapping 67 (FIG. 13).

Using this way of fastening eliminates direct tension from nail 64 onto tile 10. It also increases the surface area of contact to tile 10 by overlap or head 99 of fastener 73. Stresses due to expansion, contraction, loads etc. are getting effectively absorbed by fastener 73, protecting tile 10.

The head 99 of snapper 73 preferably forms a lip or flange 100 around the circumference of the head 99 which is seated in the seat 79 of the aperture 55.

The present invention thus provides:

A roof tile 10 which is designed in such a way as to interlock and slidingly engage with all its surrounding neighbour roof tiles 10 in such a way that it prevents lifting of the top tiles from the bottom tiles. This roof tile 10 has the interlocking capability not only to interlock loosely, but to engage onto the lower tile 10 in such a way as to prevent lifting of the top tiles from the bottom tiles.

Figure 2:
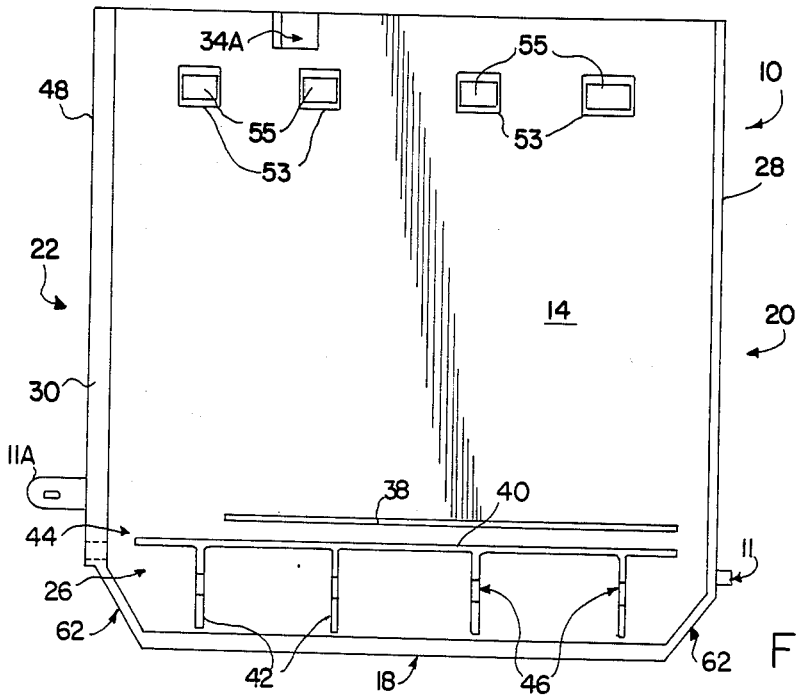
FIG. 2 shows, in bottom plan view, the roof tile of FIG. 1.

A roof tile which has protrusions or flanges 11, 11 A on both front ends of the tile protruding to the left and right side of the tile, opposing each other (e.g. FIGS. 1 and 2).

A roof tile 10 with interlocking formations 11, 11 A, 13, 34 A which are forming a self-supporting roof structure which even with no strapping support of profile support over the distance of three laterally and three longitudinally engaged tiles creates a self-supporting roof which does not collapse.

A roof tile 10 which has a cut-out 13 at the bottom of the front end of the tile at one side and an open protrusion 34 A at the top of the tile towards and near the rear of the tile 10, preferably offset from the middle.

A roof tile 10 which has the capability to slidingly engage through right and left movements into the tile underneath by means of the front flange 11 A at the bottom end of the top tile into the protrusion 34 A at the rear of the bottom tile.

A roof tile which can slidingly engage with its neighbour tile through a flange 11 at the bottom end of the tile opposing and directionally opposite to the other flange 11 A. The engagement takes place by sliding the flange 11 into the opening 13 provided at the front bottom end of its neighbour tile.

A roof tile 10 which through own means of interengaging with all its neighbors top and bottom, side to side forms a self-supporting structure still able to allow thermal expansion and contraction in all directions.

A roof tile 10 which has a channel protrusion 38 at the bottom front of the tile underneath, and protrusions 32, 34 at the top of the tile towards the rear end of the tile to act as wind and weather barrier.

A roof tile 10 which through its interlocking and sliding engagement in combination with the wind and weather barrier 32, 34 underneath the tile builds an effective wind and weather barrier, creating a larger back pressure directed towards the front end of the tile. Because of its larger windbreak area in comparison to the size of area in which wind can enter, any rain or moisture or dust driven in through the front of the tile through the openings between the bottom tile and top tile are getting blocked effectively; this prevents the roof to leak due to moisture penetration under the roof tile.

A roofing system out of different tile shapes which does not require a solid understructure or decking but forms in itself an all-weather proof skin.

A roof tile 10 which through its fastening mechanism by means of fasteners 72 or 73 does not develop stress cracks in the material, therefore enhancing the life of the tile.

A roofing system which allows assembly of roof tiles and fastening to profiles without tools but by pushing of fingers only, and makes it ideal for non-skilled labour use, further eliminating greatly the possibility of accidents from usage of tools.

A roofing system which allows the design of clear and coloured tiles on a roof all of the same homogenous material, allowing for equal thermal expansion or contraction.

A roof tile which allows a maximum of flexibility and movement as to compensate greatly for structural roof faults.

A roof tile and fastening system which allows a unique roof design and which can be completely disassembled without breakage and can be completely reused many times.

A fastening system which, by means of fastener 72 and profile 66, allows lateral movement of the tiles 10 and fasteners 72 along the path of the profile and therefore enabling disassembly of the roof without breakage.

A roof tile system which, by using transparent tiles, retains the optical three-dimensional appearance of the roof, yet allowing ultraviolet rays to pass through the roof tiles for utilization of solar energy under the roof skin.

A fastening device to fix the roof tile into position on strappings or profiles.

A fastening device which through engagement through openings provided in roof tiles can fix such tiles to strappings by means of nailing, screwing or stapeling. Such tiles can h=fixed into position, yet absorbing any tension directly applied through such fixing in itself, and transferring only indirect pressure over a greater surface area of the fastening element onto the tile.

A fastening device which has protruding lips 78 or 100 all around at the top end. They engage into seats 79 provided in the tiles.

A roof tile which has openings 55 toward the rear end of the tile to accept fastening devices. These openings 55 have incorporated seats 79 surrounding the openings 55 as to accept the lips 75 or 100 of such fasteners 72 or 73. This way, the tile 10 is held in position without bearing direct tension supplied to the fastening elements 72 or 73 by means of fixing same onto the strappings 67 or profiles 66.

A fastening element 72 to fix the roof tiles 10 into position onto a profile 66 provided to accept fastening elements 72.

A fastening element 72 comprising lips 75 around the top 78 and snapper feet 84 at the bottom end of the fastening element 72. The feet 84 engage through downward pressure into seats 88 provided in the profile 66. The lips 75 of the fastener 72 hold the tile 10 in position on the profile 66. The snapper feet 84 engaged into the profile 66 hold the tile 10 through the lip 75 at the top 78 of the fastening device 72. This way, the tile 10 is fixed to the profile 66 yet can be moved slidingly in the directions of the profile 66.

A profile 66 to accept the fastening element 72 for the roof tiles 10.

A profile 66 consisting of two or more supportive shoulders 88 or crevices to accept the fastener feet 84.

A profile 66 having a protrusion 94 engaging in between the snapper feet 84 and to open same up into opposing directions once fixed into position. Slight pressure between the snapper feet 84 and corresponding shoulders 88 or crevices in the profile 66, accepting such feet 84, gets this way supplied. This ensures that the fastener element 72 cannot vertically (this means up or down) be removed. It allows however a sliding movement along the path of the profile 66.

A roofing system which can be assembled and disassembled without breakage many times, always using the same building elements.

I claim:

1. A roof tile comprising an upper side and an under side, first and second lateral edges, first and second transverse edges, a downward-oriented flange running longitudinally along one lateral edge of said tile and a complementary upward-facing channel running longitudinally along the other lateral edge of said tile whereby a flange of one said tile will rest loosely in said channel of a second neighbouring said tile, a transverse groove running laterally along the upper side of said tile adjacent one transverse edge thereof and a complementary downward-facing ridge running transversely along the under side of said tile adjacent the other transverse edge thereof whereby said ridge of one tile will rest loosely in said groove of a second neighbouring tile, said tile being thereby adapted for interlocking engagement with laterally neighbouring tiles and overlapping engagement with longitudinally neighbouring tiles, said tile further comprising means for fastening said tile to a roof whereby said tile is provided with an aperture for receiving a resilient plug, said plug having a surface for bearing against said tile and being adapted to receive fastening means for fastening said plug to said roof and thereby resiliently fastening said tile to said roof.

2. The roof tile of claim 1 wherein said plug comprises a head portion having a width greater than the width of said aperture, and a neck portion connected to said head portion, said aperture being adapted to receive said neck portion with said head portion bearing against the upper outer edge of said aperture.

3. The roof tile of claim 2 wherein said plug is adapted to receive a nail or screw through the centre of said head and neck portions.

4. The roof tile of claim 2 wherein said aperture is located in a raised boss which forms a seat for said head of said plug.

5. The roof tile of claim 3 wherein said plug is provided with an aperture for receiving said nail or screw.

6. The roof tile of claim 2 wherein said fastening means comprises a base element which releasably receives the end of said plug opposite said head portion, and which base element is in turn adapted to be fastened to a vertical element of said roof.

7. The roof tile of claim 2 wherein said fastening means comprises a base element which releasably receives the end of said plug opposite said head portion, and which base element is in turn adapted to be fastened to a vertical element of said roof.

8. The roof tile of claim 7 wherein said end of said plug opposite said head is provided with ridges for grippingly engaging said base element.

9. The roof tile of claim 7 wherein said base element comprises a vertical fastening plate for fastening to said vertical element of said roof and a plug-receiving element secured to said fastening plate further comprising an aperture having a shoulder for releasably engaging said plug.

10. The roof tile of claim 9 wherein said aperture in said plug-receiving element is extended in one direction.

11. The roof tile of claim 1 further comprising a tab extending from one lateral edge thereof and an upwardly protruding element located centrally of the upper side of a transverse edge thereof and having a slot therein for receiving said tab, whereby overlapping rows of said tiles may be interlocked.

* * * * *